US010021978B1

(12) United States Patent
Chen et al.

(10) Patent No.: US 10,021,978 B1
(45) Date of Patent: Jul. 17, 2018

(54) CLUTCH FOR FURNITURE PARTS

(71) Applicants: KING SLIDE WORKS CO., LTD., Kaohsiung (TW); KING SLIDE TECHNOLOGY CO., LTD., Kaohsiung (TW)

(72) Inventors: Ken-Ching Chen, Kaohsiung (TW); Hsiu-Chiang Liang, Kaohsiung (TW); Chun-Chiang Wang, Kaohsiung (TW)

(73) Assignees: KING SLIDE WORKS CO., LTD., Kaohsiung (TW); KING SLIDE TECHNOLOGY CO., LTD., Kaohsiung (TW)

( * ) Notice: Subject to any disclaimer, the term of this patent is extended or adjusted under 35 U.S.C. 154(b) by 0 days.

(21) Appl. No.: 15/721,973

(22) Filed: Oct. 2, 2017

(30) Foreign Application Priority Data

Apr. 12, 2017 (TW) ..... 106112319 A

(51) Int. Cl.

| | |
|---|---|
| ***A47B 88/00*** | (2017.01) |
| ***A47B 88/46*** | (2017.01) |
| *A47B 88/493* | (2017.01) |
| *A47B 88/473* | (2017.01) |

(52) U.S. Cl.
CPC ..... *A47B 88/46* (2017.01); *A47B 88/473* (2017.01); *A47B 88/493* (2017.01)

(58) Field of Classification Search
CPC ..... A47B 88/46; A47B 88/463; A47B 88/467; A47B 88/47
See application file for complete search history.

(56) References Cited

U.S. PATENT DOCUMENTS

| | | | | |
|---|---|---|---|---|
| 8,172,345 | B2 | 5/2012 | Liang | |
| 8,801,120 | B2 * | 8/2014 | Chen | A47B 88/47 312/333 |
| 9,215,929 | B2 * | 12/2015 | Brunnmayr | A47B 88/0481 |
| 9,648,951 | B2 * | 5/2017 | Albrecht | E05B 63/22 |
| 9,655,447 | B2 | 5/2017 | Brunnmayr | |
| 9,681,748 | B2 * | 6/2017 | Chen | A47B 88/453 |
| 2009/0273263 | A1 * | 11/2009 | Berger | A47B 88/467 312/334.1 |

(Continued)

FOREIGN PATENT DOCUMENTS

| | | |
|---|---|---|
| TW | I536933 B | 6/2016 |
| TW | I538638 B | 6/2016 |
| TW | I572304 B | 3/2017 |

*Primary Examiner* — Daniel J Rohrhoff
(74) *Attorney, Agent, or Firm* — Winston Hsu

(57) ABSTRACT

A clutch includes a first transmission member, a second transmission member, at least one abutting member, a control base and an engaging member. The second transmission member is movably connected to the first transmission member. The at least one abutting member is movably mounted between the first transmission member and the second transmission member. The control base provides a limited space. The engaging member is movably mounted in the limited space. Wherein, the engaging member is not engaged with the second transmission member when the control base is in a first state relative to the second transmission member. Wherein, the engaging member is engaged with the second transmission member when the control base is in a second state relative to the second transmission member.

16 Claims, 20 Drawing Sheets

(56) References Cited

U.S. PATENT DOCUMENTS

| | | | | |
|---|---|---|---|---|
| 2010/0176700 | A1* | 7/2010 | Perez | A47B 88/467<br>312/334.8 |
| 2011/0012488 | A1* | 1/2011 | Liang | A47B 88/47<br>312/319.1 |
| 2017/0051813 | A1* | 2/2017 | Karu | E05F 1/16 |
| 2018/0003339 | A1* | 1/2018 | Chen | A47B 88/473 |

* cited by examiner

CLUTCH FOR FURNITURE PARTS

BACKGROUND OF THE INVENTION

1. Field of the Invention

The present invention relates to a clutch, and more particularly, to a clutch for furniture parts.

2. Description of the Prior Art

In a furniture system, such as a drawer system, a drawer usually can be opened or retracted relative to a cabinet through a pair of slide rail assemblies. A product capable of facilitating a drawer to open from a retracted position relative to a cabinet is already provided in current market, and the product is so called a push-open product. A product capable of automatically retracting a drawer relative to a cabinet in an end process of retracting is also provided in current market, and the product is so called a self-closing product. However, according to different requirements in the market, a product with both push-open and self-closing functions becomes important in product development. U.S. Pat. No. 8,172,345 B2 discloses a self-moving device for movable furniture parts, which comprises a movable part with self-opening and self-closing functions relative to a stationary part. The case is provided for reference.

SUMMARY OF THE INVENTION

The present invention relates to a clutch for furniture parts.

According to an embodiment of the present invention, a clutch comprises a first transmission member, a second transmission member, at least one abutting member, a control base and an engaging member. The second transmission member is movably connected to the first transmission member. The at least one abutting member movably mounted between the first transmission member and the second transmission member. Wherein, the first transmission member has a first abutting part, the second transmission member has a second abutting part, an abutting space is defined by the first abutting part and the second abutting part and configured to accommodate the at least one abutting member; when the at least one abutting member is located at a predetermined position, the at least one abutting member abuts against the first transmission member and the second transmission member; when the at least one abutting member is moved away from the predetermined position, the at least one abutting member does not abut against the first transmission member and the second transmission member. The control base is configured to be in one of a first state and a second state relative to the second transmission member. The engaging member is movably mounted on the control base. Wherein, when the control base is in the first state, the engaging member is not engaged with the second transmission member. Wherein, when the control base is in the second state, the engaging member is engaged with the second transmission member.

Preferably, the first transmission member and the second transmission member are pivoted to each other by a shaft.

Preferably, the second transmission member comprises a main body part and a housing part, the main body part is configured to accommodate the housing part, the main body part comprises a plurality of engagement sections separated from each other.

Preferably, the engaging member is pivoted to the control base by a shaft part, and the engaging member corresponds to the plurality of engagement sections of the second transmission member.

Preferably, the control base has a recessed part and two separated walls located adjacent to the recessed part, the recessed part provides a limited space, in order to allow the engaging member to be limitedly movable in the limited space.

According to another embodiment of the present invention, a driving mechanism is configured to drive a first furniture part to move relative to a second furniture part. The driving mechanism comprises a first elastic member, a clutch, a second elastic member and a connecting device. The clutch is configured to releasably lock the first elastic member. The clutch comprises a first transmission member, a second transmission member, at least one abutting member, a control base and an engaging member. Wherein, the first transmission member is movable on the second furniture part, the second transmission member is movably connected to the first transmission member, an abutting space is defined by the first transmission member and the second transmission member and configured to accommodate the at least one abutting member, the at least one abutting member is configured to abut against the first transmission member and the second transmission member when the at least one abutting member is located at a predetermined position, the at least one abutting member does not abut against the first transmission member and the second transmission member when the at least one abutting member is moved away from the predetermined position, the control base is configured to be selectively in one of the first state and the second state, the engaging member is pivoted to the control base. The connecting device is connected to the second elastic member. Wherein, when the clutch locks the first elastic member, the first elastic member accumulates a first elastic force; and when the clutch releases the first elastic member, the first elastic member releases the first elastic force to drive the first furniture part to move relative to the second furniture part from a retracted position toward an open position along a first direction. Wherein, when the first furniture part is moved a predetermined distance relative to the second furniture part from the open position toward the retracted position along a second direction, the control base is switched from the second state to the first state in order to lock the first elastic member, and the second elastic member generates a second elastic force, such that the first furniture part is moved relative to the second furniture part from the open position to the retracted position along the second direction in response to the second elastic force.

According to yet another embodiment of the present invention, a clutch is applicable to a first base and a connecting member. The clutch comprises a first transmission member, a second transmission member, a control base and an engaging member. The second transmission member is movably connected to the first transmission member. The control base has a portion pivoted to the connecting member. The control base is arranged with a guiding member. The engaging member movably is mounted on the control base. Wherein, the control base has a recessed part and two separated walls located adjacent to the recessed part, the recessed part provides a limited space to allow the engaging member to be limitedly movable in the limited space. Wherein, the first base provide a space to accommodate the clutch, the first base has a control path, the control path comprises a first path and a second path communicated with the first path and deflected relative to the first path, the guiding member is configured to cooperate with the control path. Wherein, when the guiding member is located in the second path of the control path of the first base, the control base is in the first state, and the engaging member does not engage with the second transmission member. Wherein, when an external force is applied to the first base, the control base is guided by a wall in the second path of the first base to deflect, in order to allow the guiding member to enter the first path from the second path of the control path, and the engaging member engages with the second transmission member.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
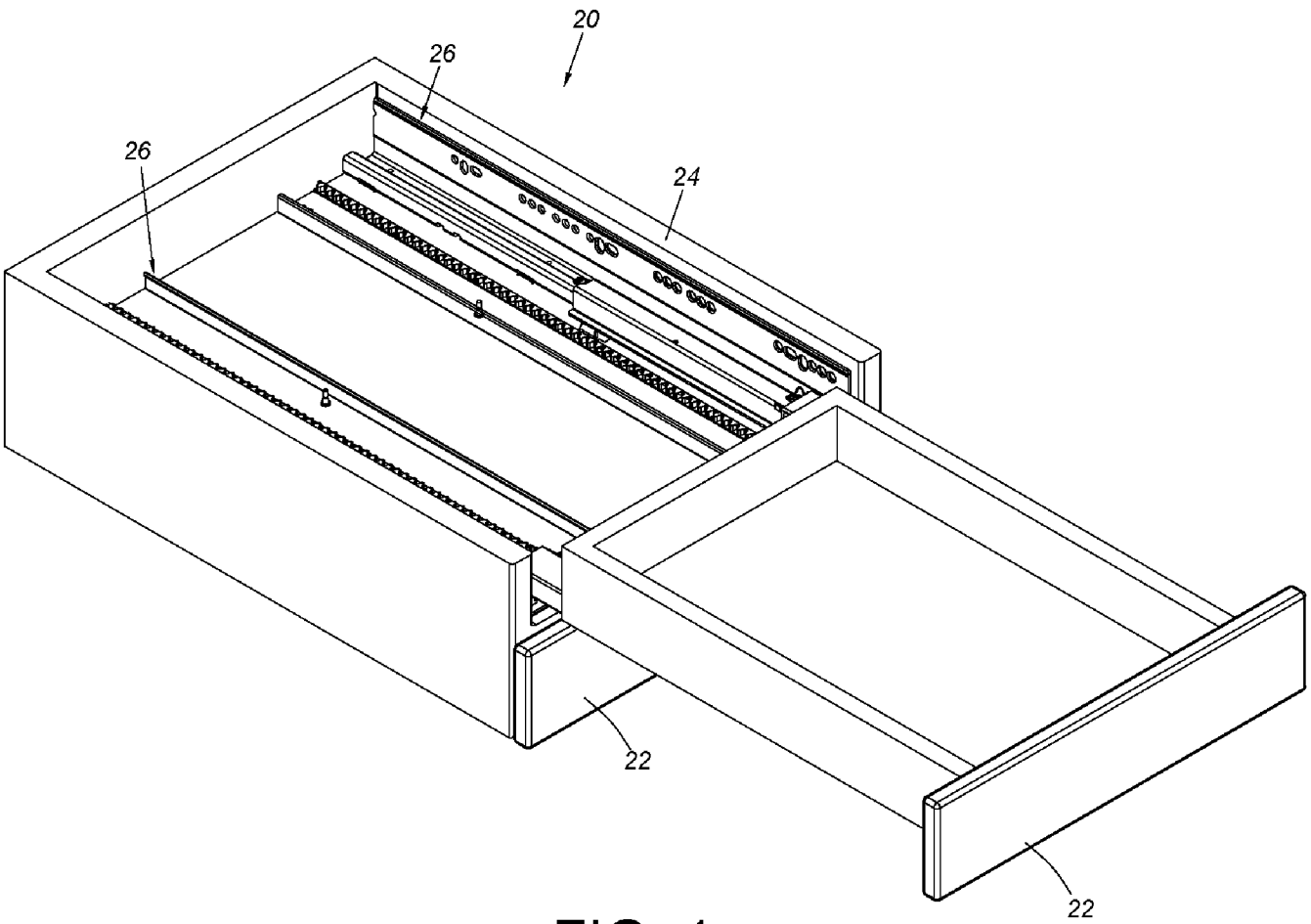
FIG. 1 is a diagram showing a drawer being opened relative to a cabinet according to an embodiment of the present invention.

FIG. 1 shows a furniture assembly 20 at least comprising a first furniture part 22, a second furniture part 24 and a pair of slide rail assemblies 26 according to an embodiment of the present invention. In the present embodiment, the first furniture part 22 is a drawer for example, and the second furniture part 24 is a cabinet for example. The pair of the slide rail assemblies 26 is mounted between the first furniture part 22 and the second furniture part 24. In the present embodiment, the slide rail assemblies 26 are undermount drawer slides, and are respectively mounted to the first furniture part 22 to be adjacent to two sides of a bottom of the first furniture part 22. According to the above arrangement, the first furniture part 22 can be easily opened or retracted relative to the second furniture part 24 through the pair of slide rail assemblies 26.

Figure 2:
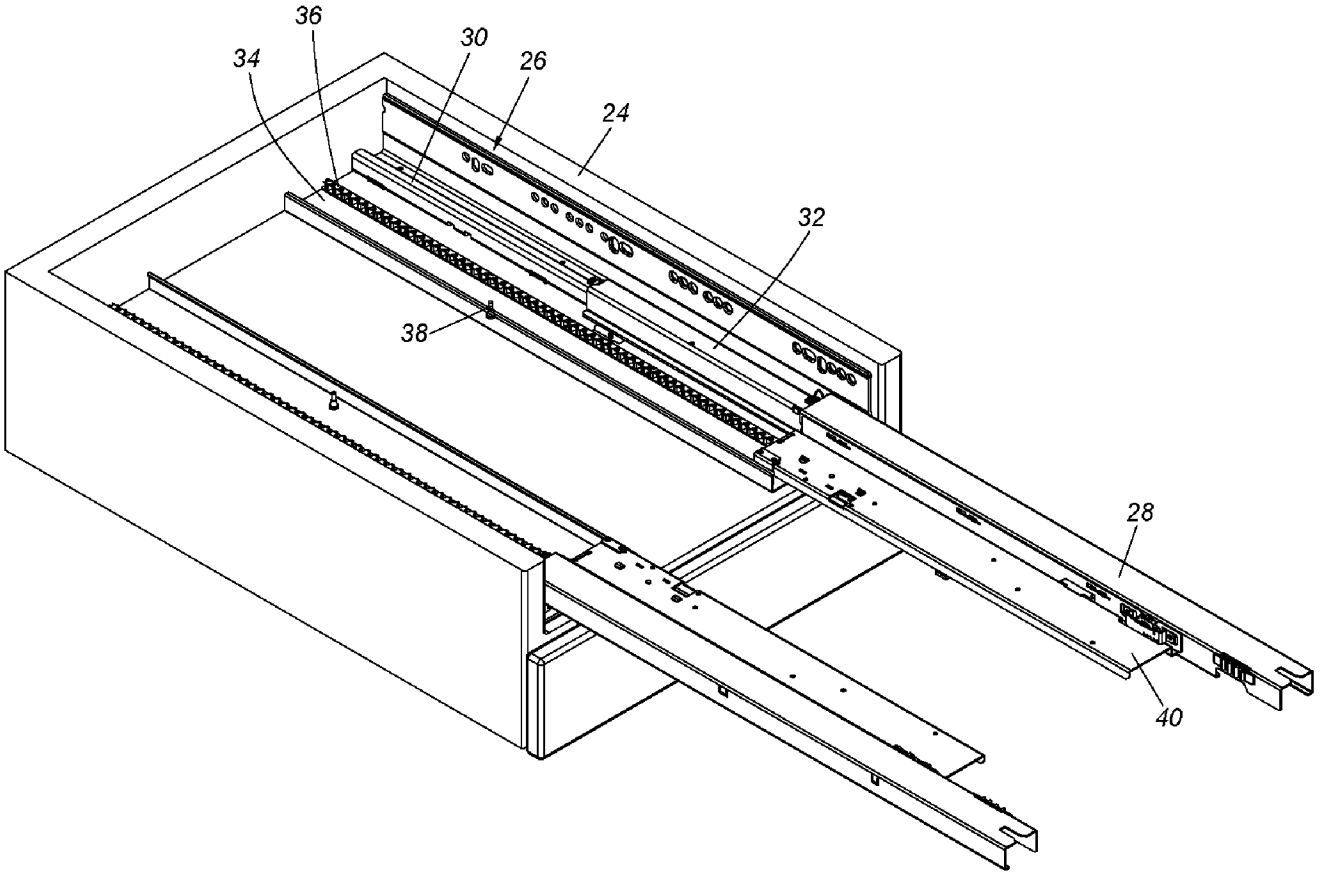
FIG. 2 is a diagram showing the cabinet of FIG. 1 with the drawer being removed.
Figure 3:
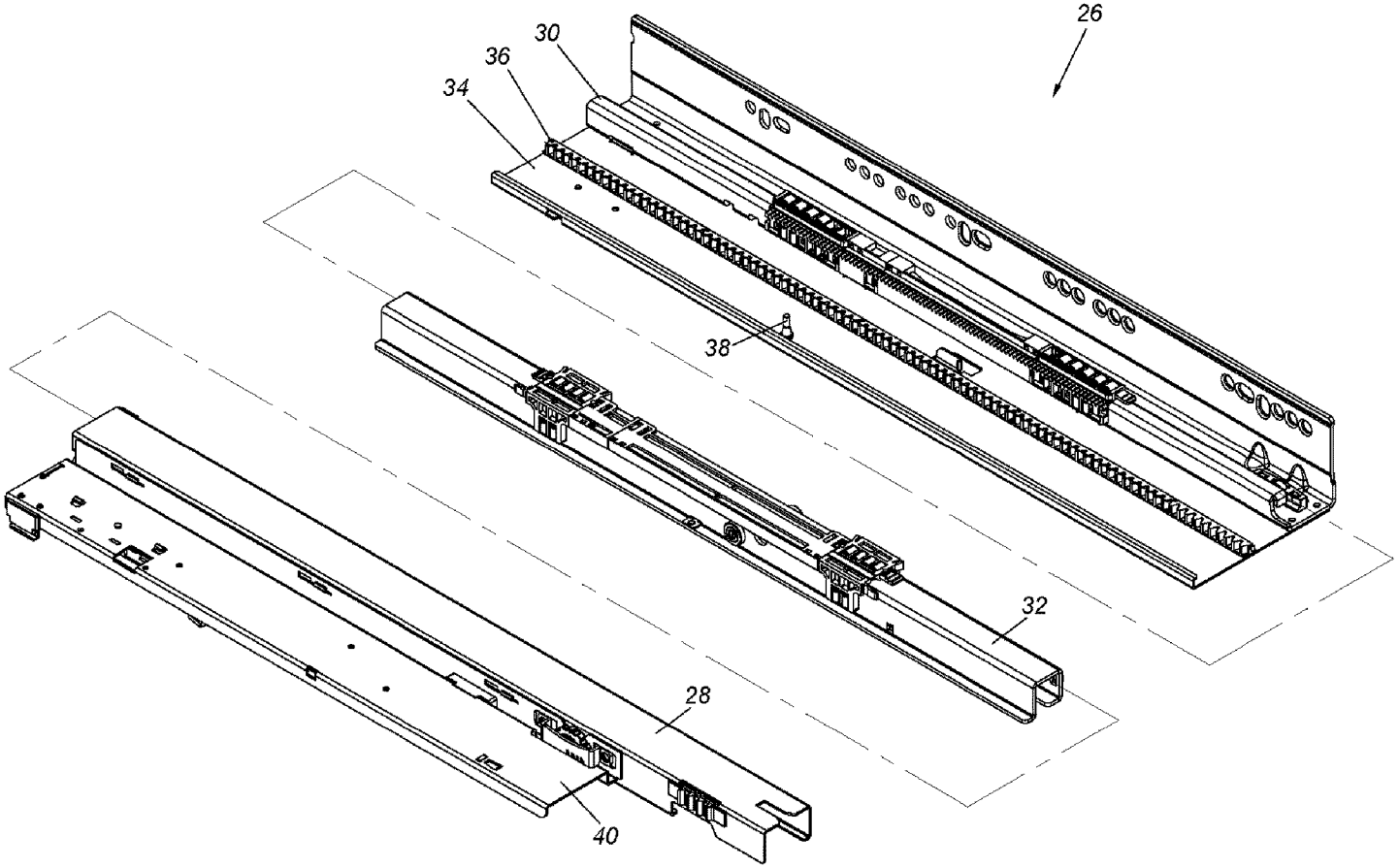
FIG. 3 is an exploded view of a slide rail assembly according to an embodiment of the present invention.

As shown in FIG. 2 and FIG. 3, the slide rail assembly 26 comprises a first rail 28 and a second rail 30. The second rail 30 is longitudinally and fixedly mounted to the second furniture part 24. As such, the second rail 30 can be seen as a portion of the second furniture part 24. The first rail 28 is longitudinally movable relative to the second rail 30. As such, the first rail 28 can be seen as a portion of the first furniture part 22. Preferably, the slide rail assembly 26 further comprises a third rail 32 movably mounted between the first rail 28 and the second rail 30. The third rail 32 is configured to extend a traveling distance of the first rail 28 relative to the second rail 30. Preferably, the slide rail assembly 26 further comprises an extension base 34 fixedly attached to the second rail 30. The extension base 34 can be seen as a portion of the second rail 30, and the extension base 34 is arranged along a longitudinal direction of the second rail 30. Preferably, the slide rail assembly 26 further comprises an auxiliary track 36 arranged along a longitudinal direction of the extension base 34. In the present embodiment, the auxiliary track 36 is a gear rack. The extension base 34 further comprises an engagement feature 38. The engagement feature 38 can be an independent component fixedly attached on the extension base 34, or the engagement feature 38 can be formed from the extension base 34.

Figure 4:
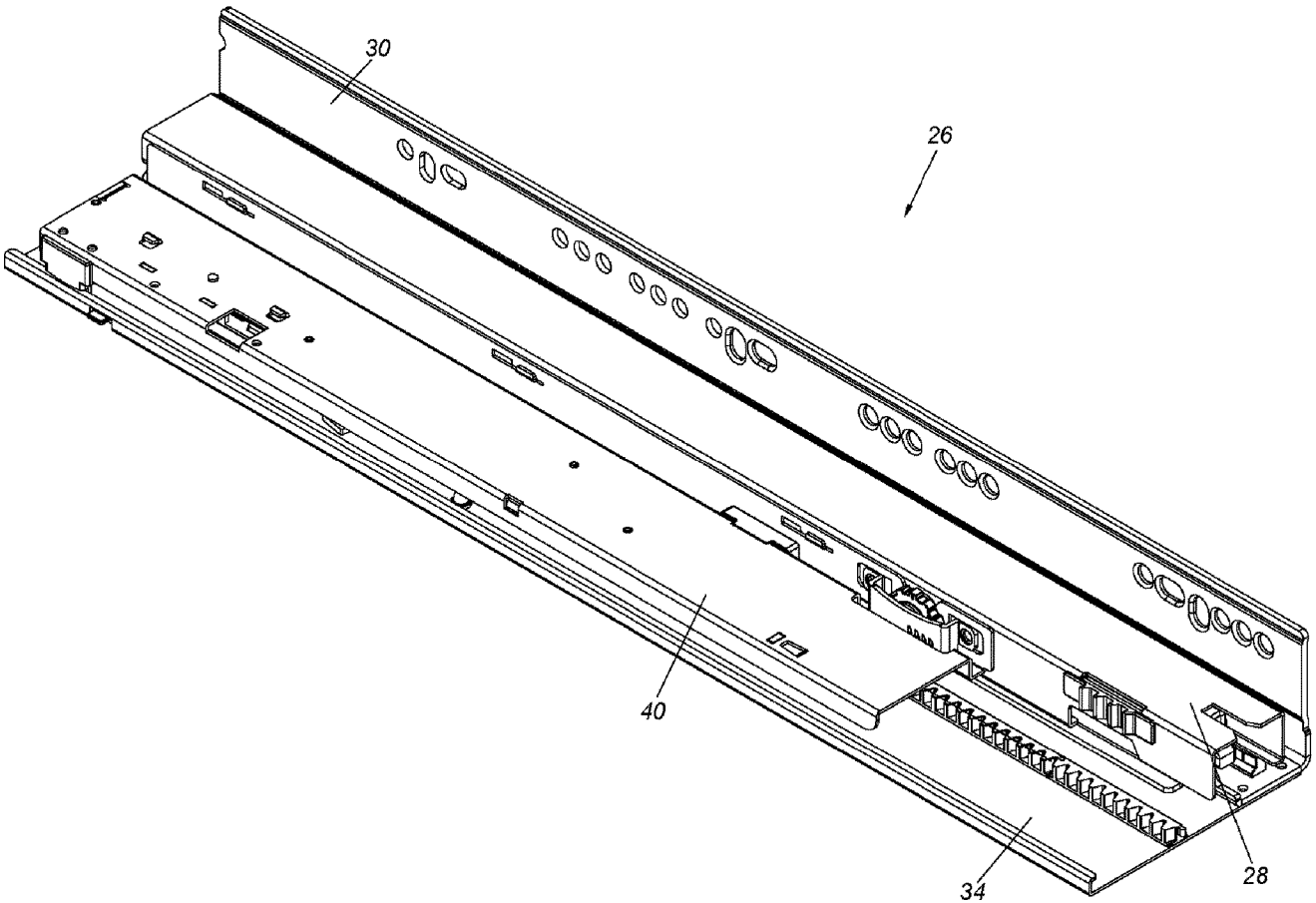
FIG. 4 is a diagram showing the slide rail assembly in a retracted state according to an embodiment of the present invention.

As shown in FIG. 4, the slide rail assembly 26 further comprises a carrying member 40 mounted to the first rail 28. The carrying member 40 can be seen as a portion of the first rail 28 (that is to say, the carrying member 40 can be seen as a portion of the first furniture part 22), and is configured to be moved with the first rail 28 relative to the second rail 30. The carrying member 40 is movable relative to the extension base 34. FIG. 4 is a diagram showing the first rail 28 being in a retracted state relative to the second rail 30. In other words, the carrying member 40 is retracted relative to the extension base 34.

Figure 5:
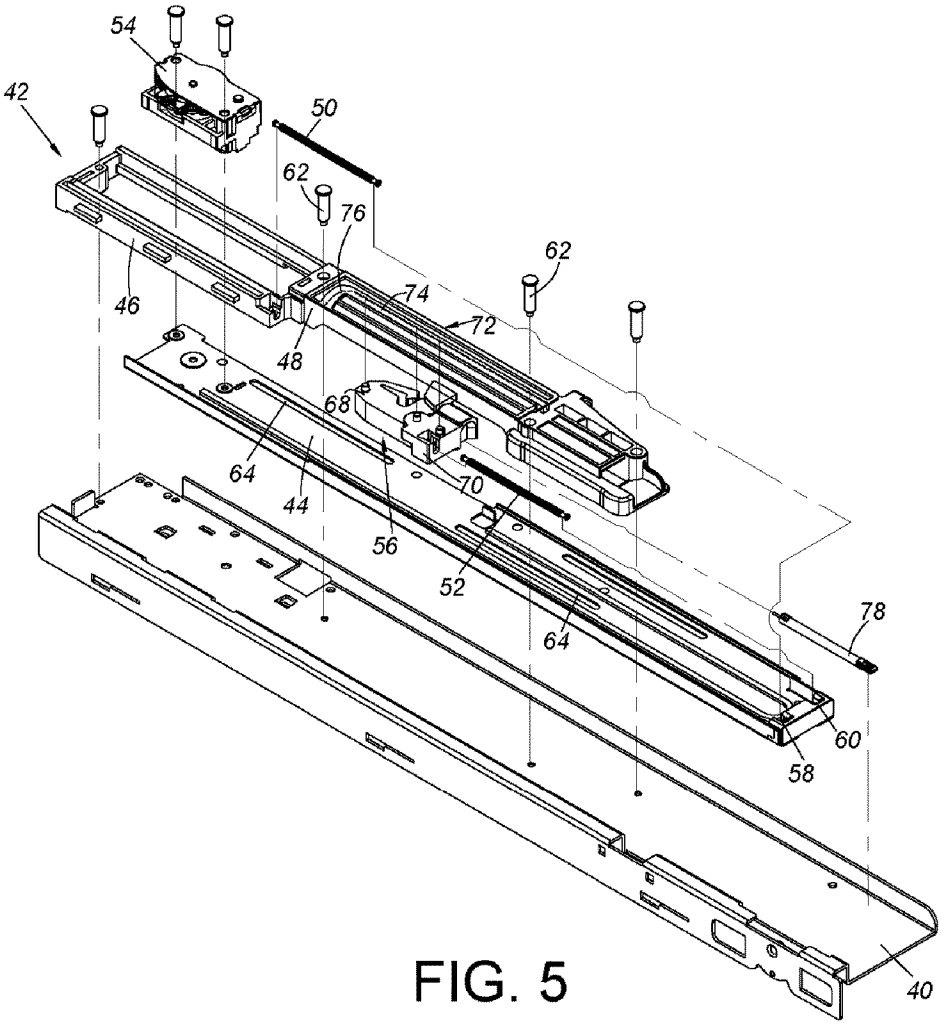
FIG. 5 is an exploded view of a driving mechanism and a carrying member according to an embodiment of the present invention.
Figure 6:
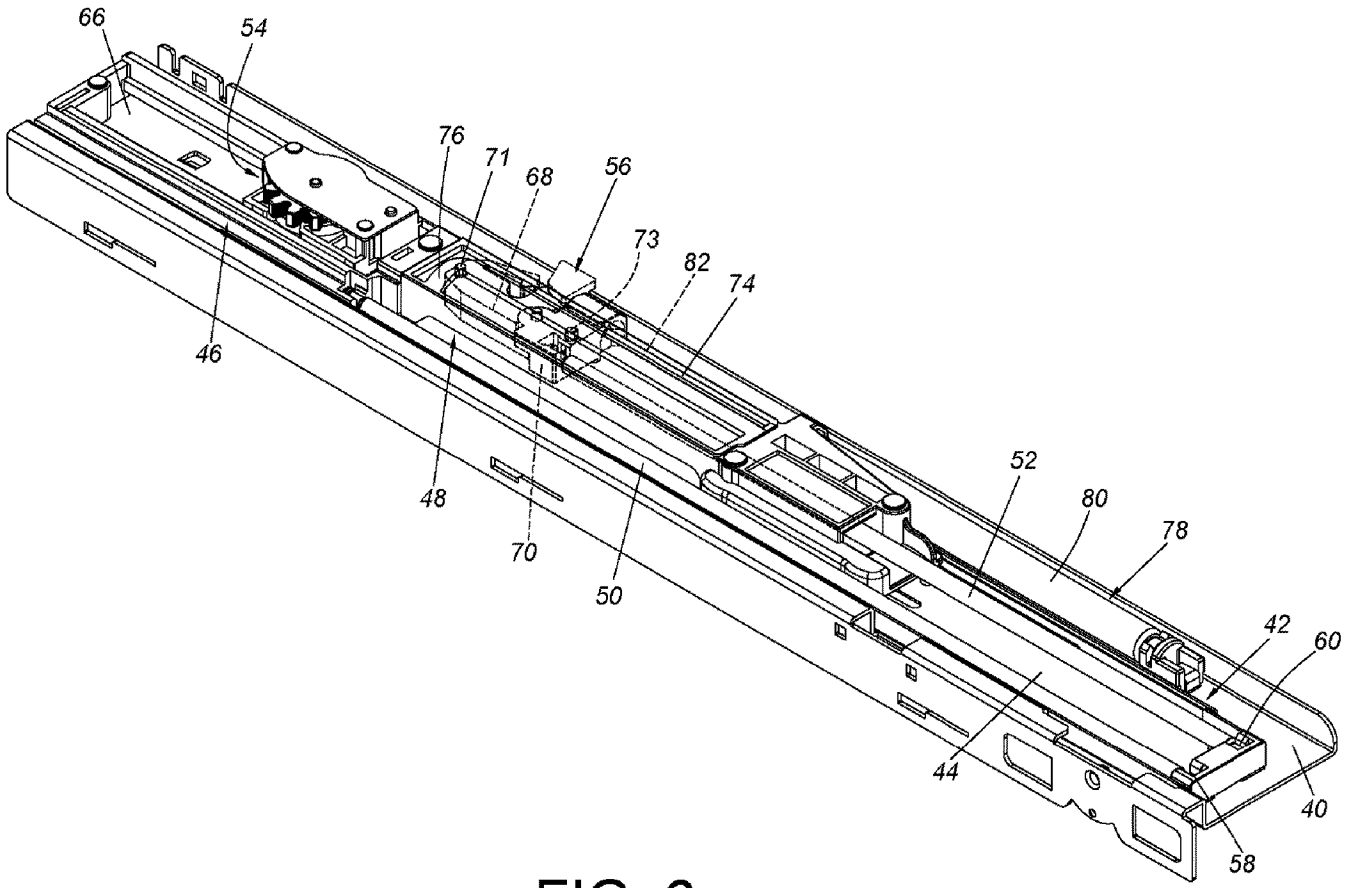
FIG. 6 is a diagram showing the driving mechanism and the carrying member of FIG. 5.

As shown in FIG. 5 and FIG. 6, the present invention provides a driving mechanism 42. The driving mechanism 42 is arranged on the carrying member 40. In particular, the driving mechanism 42 comprises a plurality of components, such as a connecting member 44, a first base 46, a second base 48, a first elastic member 50, a second elastic member 52, a clutch 54 and a connecting device 56.

The connecting member 44 is movable relative to the carrying member 40 (or the first furniture part 22). Preferably, the connecting member 44 is arranged with a first mounting part 58 and a second mounting part 60.

The first base 46 is arranged adjacent to the second base 48. For example, the second base 48 is mounted to one side of the first base 46, such that the first base 46 and the second base 48 can be seen as one piece. One of the first base 46 and the second base 48 is connected to the carrying member 40. Preferably, the first base 46 and the second base 48 are arranged with at least one fixing member 62, such as a plurality of fixing members 62. On the other hand, the connecting member 44 is arranged with at least one extension hole 64, such as a plurality of extension holes 64 located at positions corresponding to the plurality of fixing members 62. The plurality of extension holes 64 allows the connecting member 44 to be movable relative to the first base 46 or the second base 48. In particular, each of the fixing members 62 passes through a portion of a corresponding extension hole 64 and is connected to the carrying member 40 (or the first furniture part 22). Wherein, the fixing member 62 and the extension hole 64 respectively are a protrusion and a bounded hole (such as a longitudinal hole).

The first elastic member 50 is mounted to the connecting member 44. Preferably, the first elastic member 50 can be mounted between the first base 46 and the first mounting part 58 of the connecting member 44. On the other hand, the second elastic member 52 is mounted between the connecting member 44 and the connecting device 56.

The clutch 54 is arranged on the connecting member 44. The clutch 54 is configured to releasably lock the first elastic member 50. In addition, the first base 46 provides a space 66 for accommodating the clutch 54.

The connecting device 56 comprises a capturing member 68 and a blocking member 70. In the present embodiment, the capturing member 68 is movably connected, such as pivoted, to the blocking member 70. Wherein, the blocking member 70 of the connecting device 56 is connected to the second elastic member 52. For example, the second elastic member 52 can be mounted between the blocking member 70 of the connecting device 56 and the second mounting part 60 of the connecting member 44. In the present embodiment, the connecting device 56 is movably mounted to the second base 48. In particular, the second base 48 has a guiding path 72. The guiding path 72 comprises a longitudinal path 74 and a transverse path 76 communicated with the longitudinal path 74 and deflected relative to the longitudinal path 74. The capturing member 68 and the blocking member 70 are movable along the longitudinal path 74 of the guiding path 72. In the present embodiment, the capturing member 68 and the blocking member 70 respectively have a first pin 71 and a second pin 73 movable in the longitudinal path 74 of the guiding path 72.

Preferably, the driving mechanism 42 further comprises a damping device 78. The damping device 78 comprises a cylinder 80 and a damping rod 82 movable relative to the cylinder 80. The damping device 78 is well known to those skilled in the art, therefore, no further illustration is provided. Wherein, the damping rod 82 is located at a position corresponding to one of the capturing member 68 and the blocking member 70. In the present embodiment, the damping rod 82 is located at a position corresponding to the blocking member 70 for example.

Figure 7:
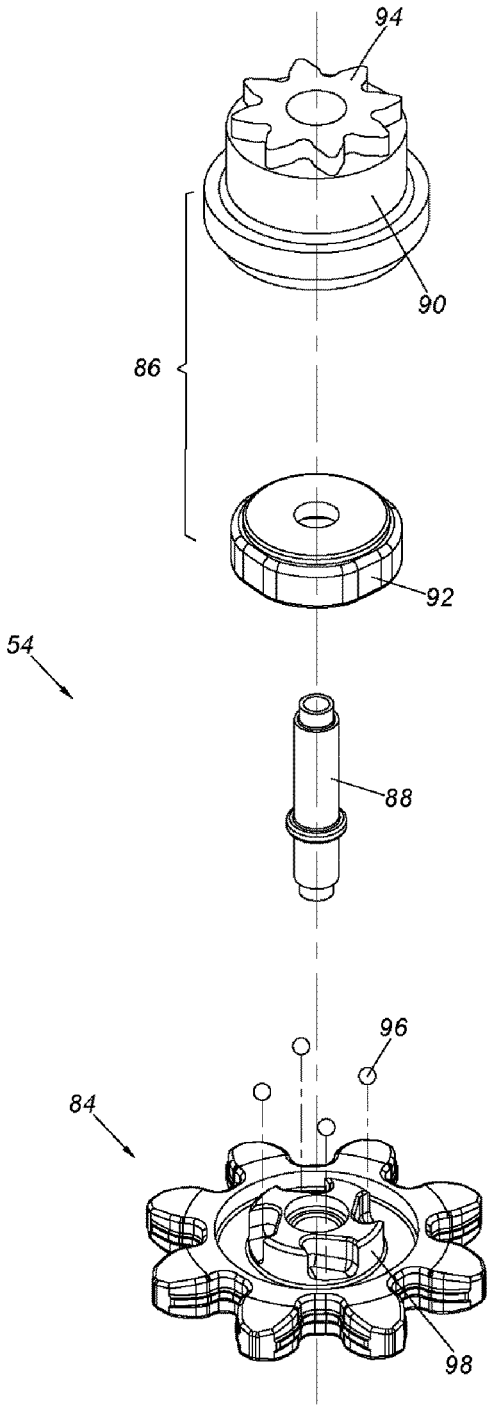
FIG. 7 is an exploded view of some of components of a clutch of the driving mechanism according to an embodiment of the present invention.

As shown in FIG. 7, the clutch 54 comprises a first transmission member 84 and a second transmission member 86 movably connected to the first transmission member 84. In the present invention, the first transmission member 84 and the second transmission member 86 are pivoted to each other by a shaft 88. The first transmission member 84 is movable on the second furniture part 24. For example, the first transmission member 84 is movable along the auxiliary track 36. In particular, the first transmission member 84 is meshed to the auxiliary track 36 of the extension base 34 of the second rail 30 to be movable along the auxiliary track 36. The second transmission member 86 comprises two parts, such as a main body part 90 and a housing part 92. The main body part 90 and the housing part 92 can be formed in one piece. Or, the main body part 90 can have a mounting space (not shown) for accommodating the housing part 92. As such, when the housing part 92 is mounted to the main body part 90, the main body part 90 and the housing part 92 can be seen as one piece. Wherein, the main body part 90 has a plurality of engagement sections 94 separated from each other.

Figure 8:
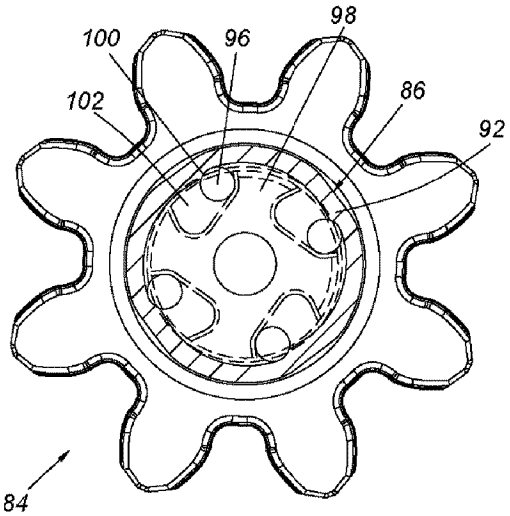
FIG. 8 is a diagram showing two transmission members abutting against each other when an abutting member of the clutch is located at a predetermined position according to an embodiment of the present invention.
Figure 9:
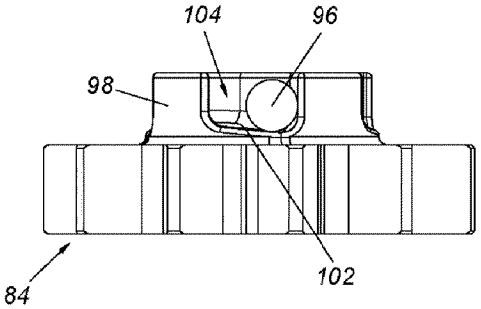
FIG. 9 is a diagram showing the abutting member of FIG. 8 in another angle.

As shown in FIG. 8 and FIG. 9, the clutch 54 further comprises at least one abutting member 96 movably mounted between the first transmission member 84 and the second transmission member 86 (such as the housing part 92). In particular, the first transmission member 84 is arranged with at least one first abutting part 98, and the second transmission member 86 (such as the housing part 92) is arranged with at least one second abutting part 100. In addition, the first transmission member 84 has an inclined face 102. Wherein, an abutting space 104 is defined between the first abutting part 98 of the first transmission member 84 and the second abutting part 100 of the second transmission member 86 for accommodating the abutting member 96. Preferably, the inclined face 104 is arranged on the first transmission member 84 and adjacent to the first abutting part 98. The abutting member 96 is movable on the inclined face 102. For example, when the first transmission member 84 is rotated along a first moving direction, the abutting member 96 is moved to a predetermined position on the inclined face 102 to abut against the first abutting part 98 of the first transmission member 84 and the second abutting part 100 of the second transmission member 86, such that the first transmission member 84 can drive the second transmission member 86 to move along the first moving direction through the abutting member 96.

Figure 10:
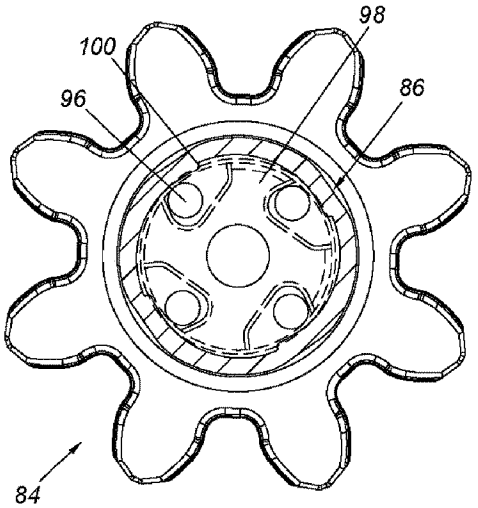
FIG. 10 is a diagram showing the abutting member of the clutch away from the predetermined position according to an embodiment of the present invention.
Figure 11:
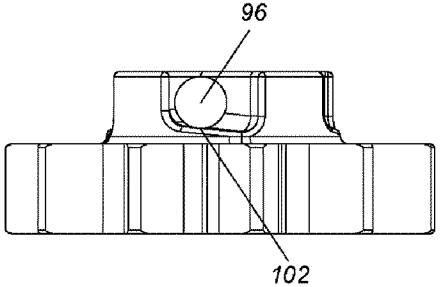
FIG. 11 is a diagram showing the abutting member of FIG. 10 in another angle.

As shown in FIG. 10 and FIG. 11, when the first transmission member 84 is rotated along a second moving direction (different from the first moving direction), the abutting member 96 is driven by the first abutting part 98 of the first transmission member 84 to move, such that the abutting member 96 is apart from the predetermined position on the inclined face 102. Thus the first transmission member 84 is not able to drive the second transmission member 86 to move along the second moving direction through the abutting member 96.

Figure 12:
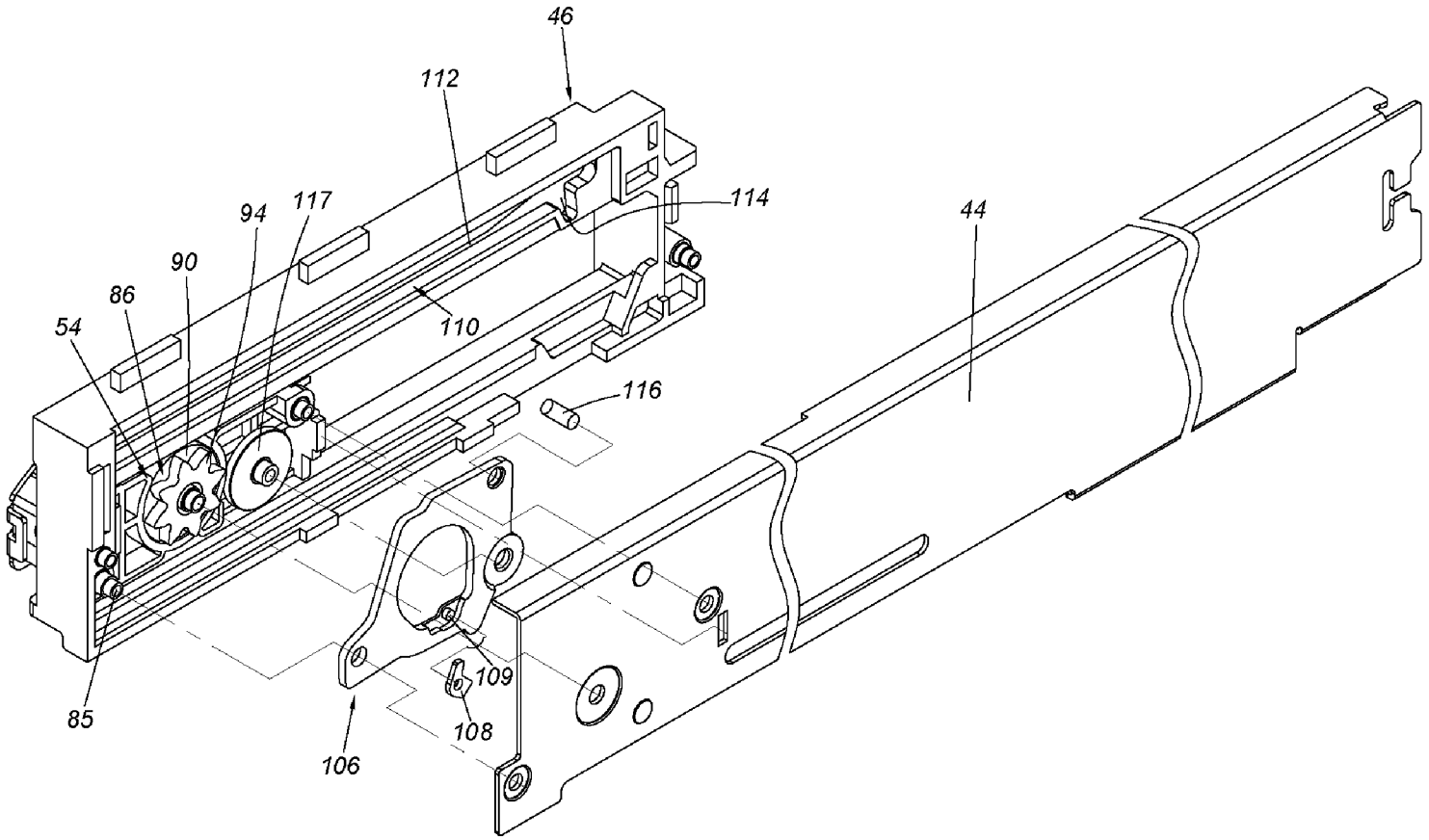
FIG. 12 is an exploded view of a control base and an engaging member according to an embodiment of the present invention.

As shown in FIG. 12, the clutch 54 further comprises a control base 106 movable relative to the second transmission member 86. In the present embodiment, a portion of the control base 106 is pivoted to the connecting member 44 by a pivoting member 85. Preferably, the control base 106 further comprises an engaging member 108 movably mounted on the control base 106. Specifically, the engaging member 108 is connected to the control base 106 by a shaft part 109, in order to pivot the engaging member 108 to the control base 106. The engaging member 108 corresponds to the plurality of engagement sections 94 of the second transmission member 86. Preferably, the clutch 54 further comprises a rolling member 117 in rolling contact with the first base 46 for reducing friction caused by movement of the first base 46 relative to the clutch 54.

Figure 13:
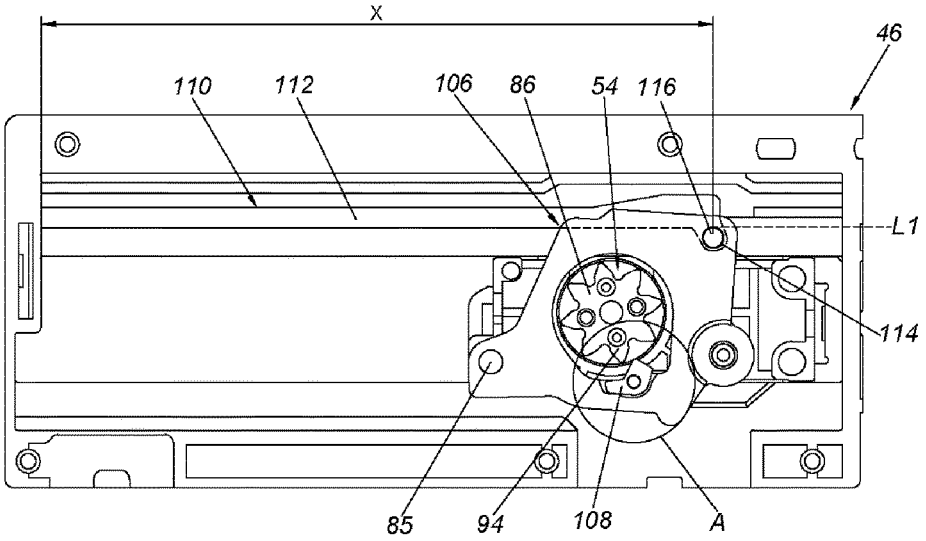
FIG. 13 is a diagram showing the clutch being in a first state relative to the first base according to an embodiment of the present invention.
Figure 14:
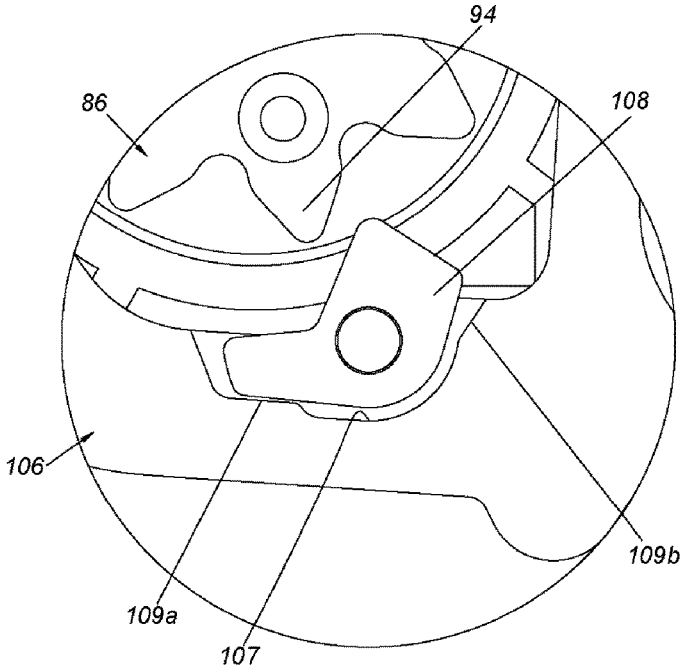
FIG. 14 is an enlarged view of an area A of FIG. 13.
Figure 15:
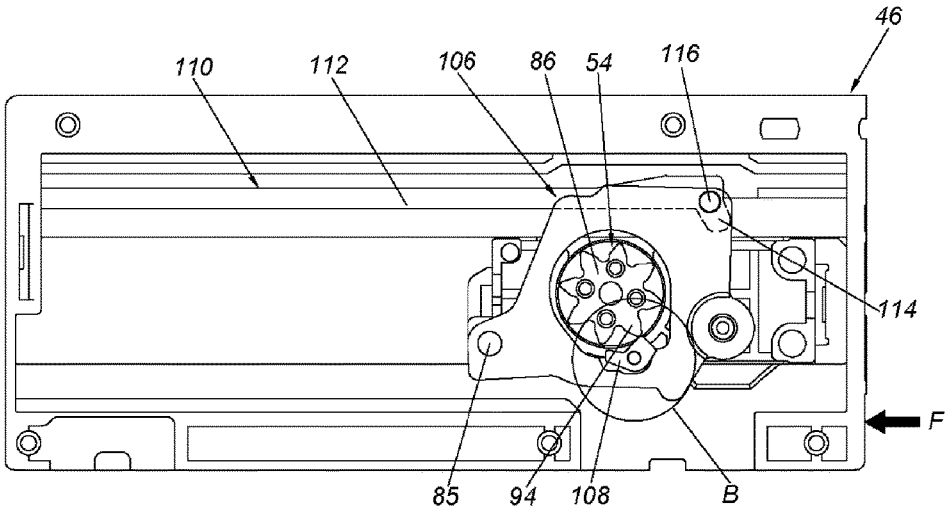
FIG. 15 is a diagram showing the clutch being no longer in the first state.
Figure 16:
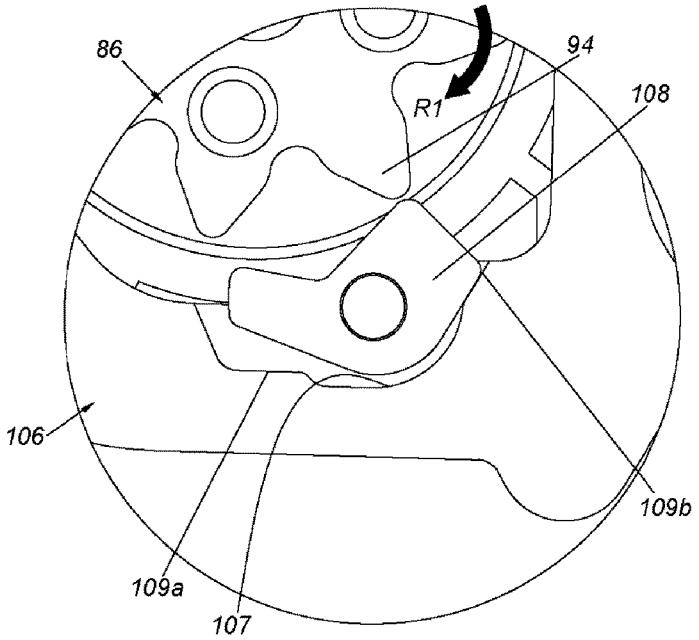
FIG. 16 is an enlarged view of an area B of FIG. 15.
Figure 17:
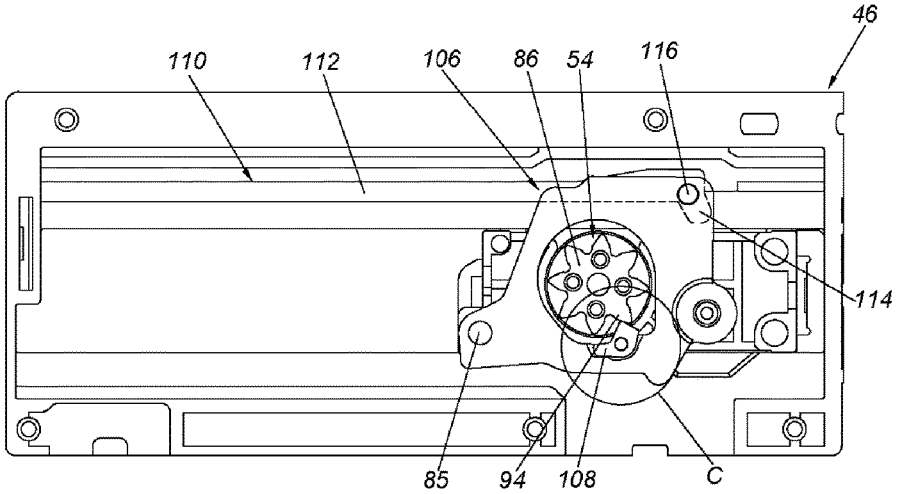
FIG. 17 is a diagram showing the clutch being no longer in the first state with the engaging member being driven to deflect.
Figure 18:
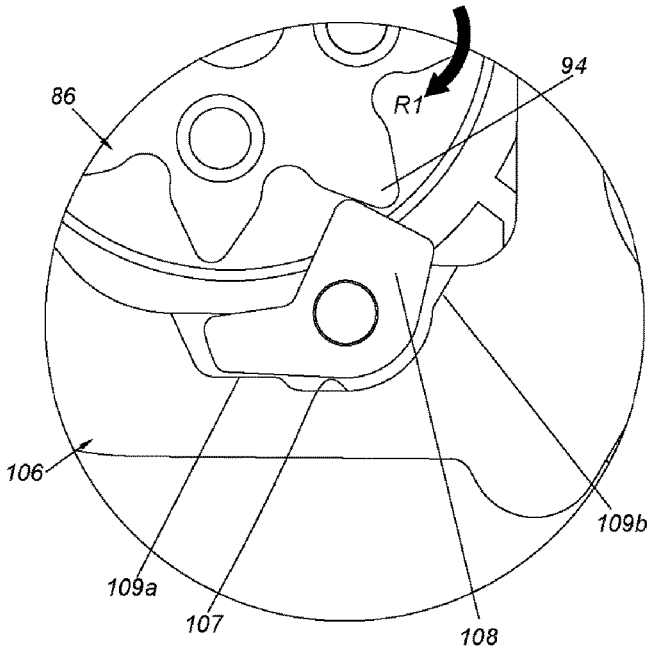
FIG. 18 is an enlarged view of an area C of FIG. 17.

As shown in FIG. 13 and FIG. 14, the first base 46 has a control path 110. The control path 110 comprises a first path 112 and a second path 114 communicated with the first path 112 and deflected relative to the first path 112. On the other hand, the control path 110 allows the control base 106 to move relative to the first base 46 or the second transmission member 86. Preferably, the control base 106 is arranged with a guiding member 116 to cooperate with the control path 110. In the present embodiment, when the guiding member 116 is located in the second path 114 of the control path 110 of the first base 46, the control base 106 is in a first state L1. As such, the engaging member 108 does not engage with the engagement section 94 of the second transmission member 86. Preferably, the control base 106 has a recessed part 107 and two separated walls 109*a*, 109*b* located adjacent to the recessed part 107. The recessed part 107 provides a limited space, in order to allow the engaging member 108 to be limitedly movable in the limited space. On the other hand, a predetermined longitudinal distance X is defined by the first path 112 of the control path 110.

As shown in FIGS. 15 to 18, when an external force is applied to the first base 46 (such as the first furniture part 22 being pressed), the control base 106 is guided by a wall in the second path 114 of the control path 110 of the first base 46 to deflect, in order to allow the guiding member 116 to enter the first path 112 of the control path 110 from the second path 114 of the control path 110. Since the engaging member 108 is movably mounted on the control base 106, the engaging member 108 can be driven by the engagement section 94 of the second transmission member 86 to moved and deflect when the engagement section 94 of the second transmission member 86 abuts against the engaging member 108.

Figure 19:
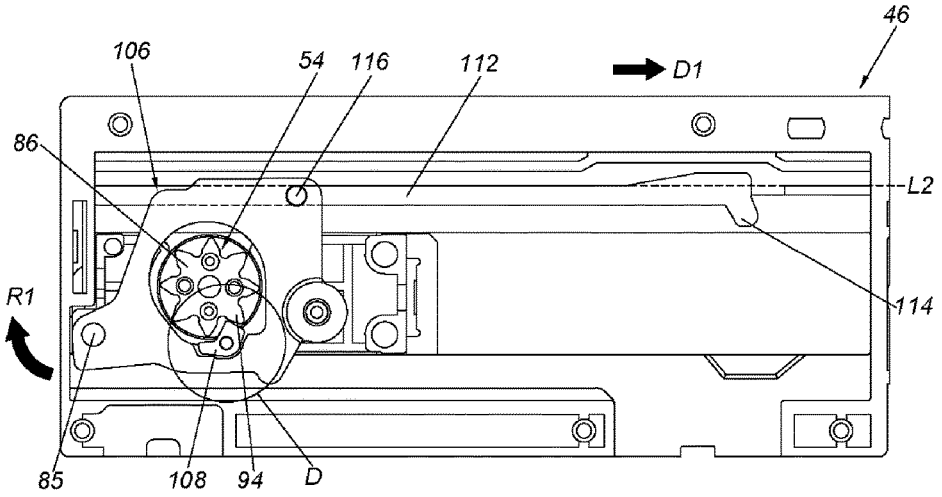
FIG. 19 is a diagram showing the clutch being switched from the first state to a second state.
Figure 20:
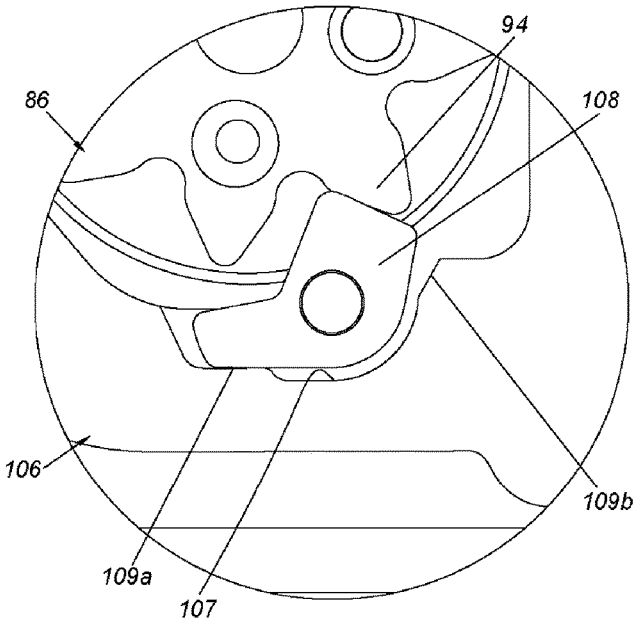
FIG. 20 is an enlarged view of an area D of FIG. 19.

As shown in FIG. 19 and FIG. 20, the control base 106 is in a second state L2 relative to the second transmission member 86. When the control base 106 is in the second state L2, the engaging member 108 is configured to engage with the engagement section 94 of the second transmission member 86 (such as abutting against each other). In other words, the engaging member 108 can be selectively engaged or not engaged with the engagement section 94 of the second transmission member 86.

According to the above arrangement, the control base 106 is configured to be selectively in one of the first state L1 and the second state L2. In other words, the clutch 54 can be in the first state L1 or the second state L2. For example, the control base 106 can be rotated and deflected relative to the second transmission member 86 to be switched from the first state L1 to the second state L2. Specifically, the control base 106 can be switched from the first state L1 to the second state L2, or switched from the second state L2 to the first state L1 through the first path 112 and the second path 114 of the control path 110.

Figure 21:
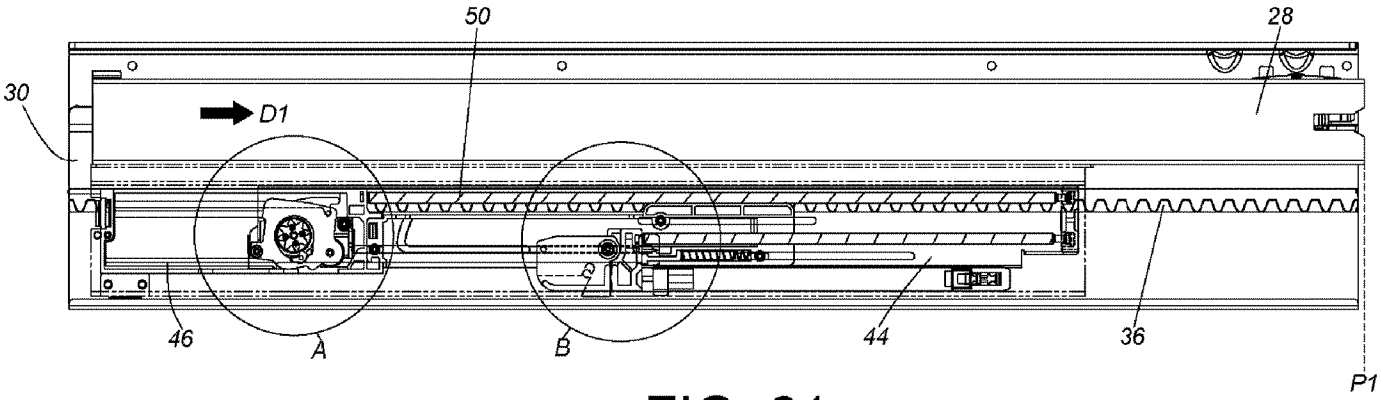
FIG. 21 is a diagram showing a first rail of the slide rail assembly located at a retracted position relative to a second rail, and a first elastic member accumulating a first elastic force along a first direction due to the clutch being in the first state according to an embodiment of the present invention.
Figure 23:
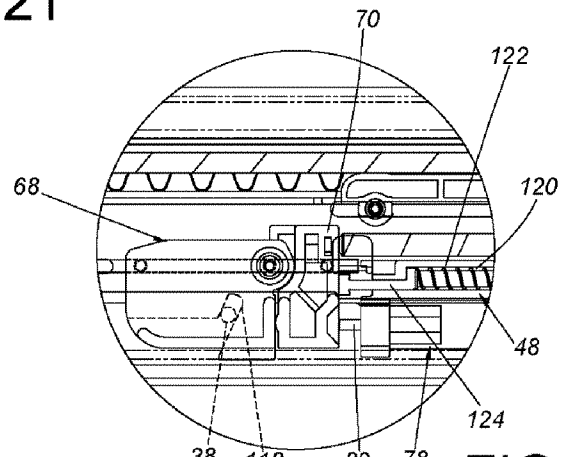
FIG. 23 is an enlarged view of an area B of FIG. 21 for illustrating a capturing member of a connecting device capturing a portion of the second rail, and the driving mechanism comprising a pushing member abutting against a blocking member of the connecting device through an auxiliary elastic member.
Figure 22:
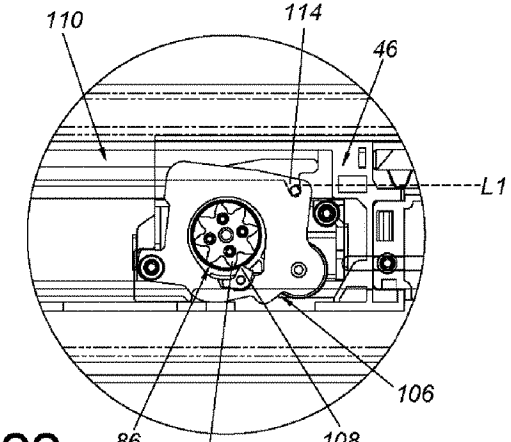
FIG. 22 is an enlarged view of an area A of FIG. 21 for illustrating the clutch being in the first state.

As shown in FIG. 21, FIG. 22 and FIG. 23, the first rail 28 is located at a retracted position P1 relative to the second rail 30 (that is, the first furniture part 22 is located at a retracted position P1 relative to the second furniture part 24). As such, the control base 106 is in the first state L1 due to the guiding member 116 being located in the second path 114 of the control path 110 of the first base 46. When in the first state L1, the engaging member 108 does not engage with the engagement section 94 of the second transmission member 86. In such state, the first transmission member 84 is movable on the auxiliary track 36 along a first direction D1 and a second direction. Since the first transmission member 84 is movable on the auxiliary track 36 along the first direction D1, the first transmission member 84 is movable relative to the second furniture part 24 from the retracted position P1 toward an open position along the first direction D1. In addition, the control base 106 is held in the first state L1 to allow the first elastic member 50 to accumulate a first elastic force (or a first driving force) applied to the connecting member 44 along the first direction D1. In other words, when the control base 106 of the clutch 54 locks the first elastic member 50, the first elastic member 50 is configured to accumulate the first elastic force. On the other hand, the capturing member 68 has a capturing feature 118 configured to capture a portion of the second rail 30 (or the second furniture part 24), such as capturing the engagement feature 38. The capturing feature 118 can be a clasp or recessed structure. Preferably, the second base 48 further comprises a room 120. The driving mechanism further comprises an auxiliary elastic member 122 and a pushing member 124 accommodated in the room 120. The auxiliary elastic member 122 is configured to provide an elastic force to the pushing member 124, for allowing the pushing member 124 to be partially extended out of the room 120 to contact the blocking member 70. In addition, the damping rod 82 of the damping device 78 abuts against the blocking member 70.

Figure 24:
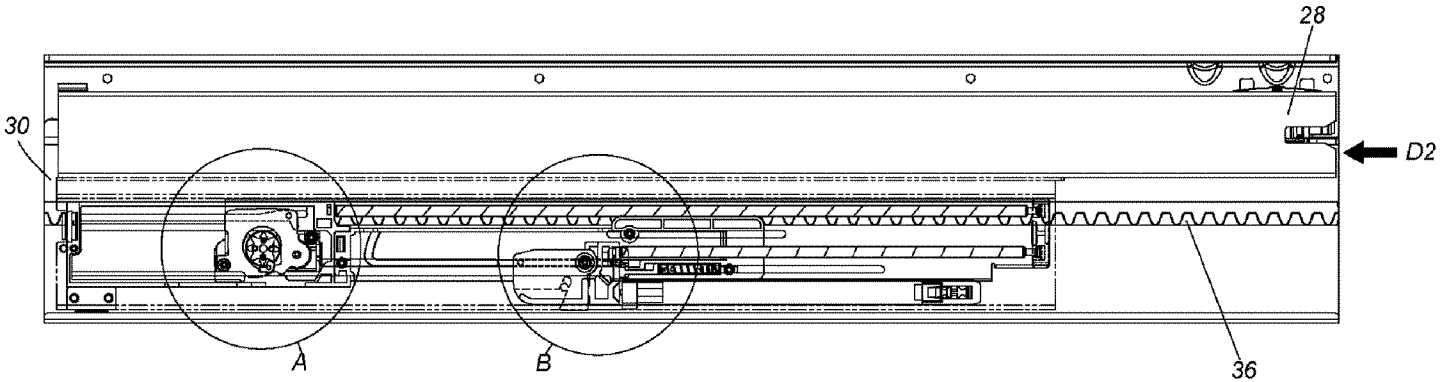
FIG. 24 is a diagram showing the first rail of the slide rail assembly being moved relative to the second rail along a second direction by an external force according to an embodiment of the present invention.
Figure 26:
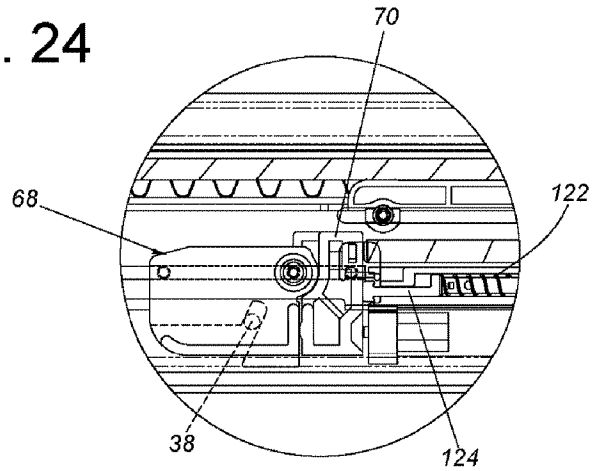
FIG. 26 is an enlarged view of an area B of FIG. 24 for illustrating the capturing member of the connecting device capturing the portion of the second rail, and the pushing member pressing the auxiliary elastic member to move a distance.
Figure 25:
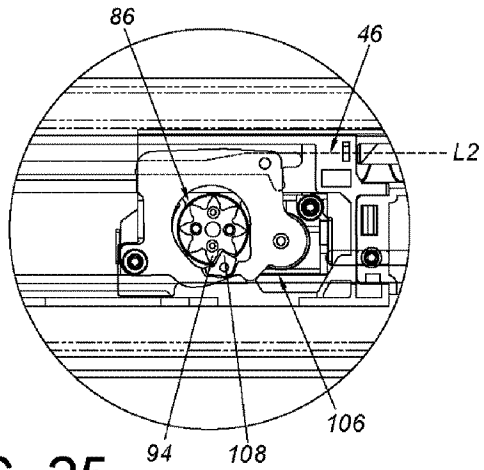
FIG. 25 is an enlarged view of an area A of FIG. 24 for illustrating the clutch being in the second state.

As shown in FIG. 24, FIG. 25 and FIG. 26, since the capturing member 68 and the engagement feature 38 of the second rail 30 engage with each other, when an external force along the second direction D2 is applied to the first rail 28, the first rail 28 is moved relative to the second rail 30 from the retracted position P1 along the second direction D2. The pushing member 124 then abuts against the blocking member 70 and presses the auxiliary elastic member 122 in response to the external force, such that the first rail 28 is moved a short distance relative to the second rail 30 along the second direction D2. The first base 46 further drives the control base 106 to move from the first state L1 to the second state L2 in response to the first rail 28 being moved along the second direction D2, such that the engaging member 108 can engage with the engagement section 94 of the second transmission member 86 (please refer to FIGS. 13 to 20 for the process of the control base 106 moving from the first state L1 to the second state L2, no further illustration is provided for simplification). In such state, the first transmission member 84 is not movable relative to the auxiliary track 36 along the second direction D2 (that is to say, the first transmission member 84 is not movable relative to the second furniture part 24 along the second direction D2). In other words, in such state, the first transmission member 84 is movable on the auxiliary track 36 only along the first direction D1 (the direction opposite to the second direction D2).

Figure 27:
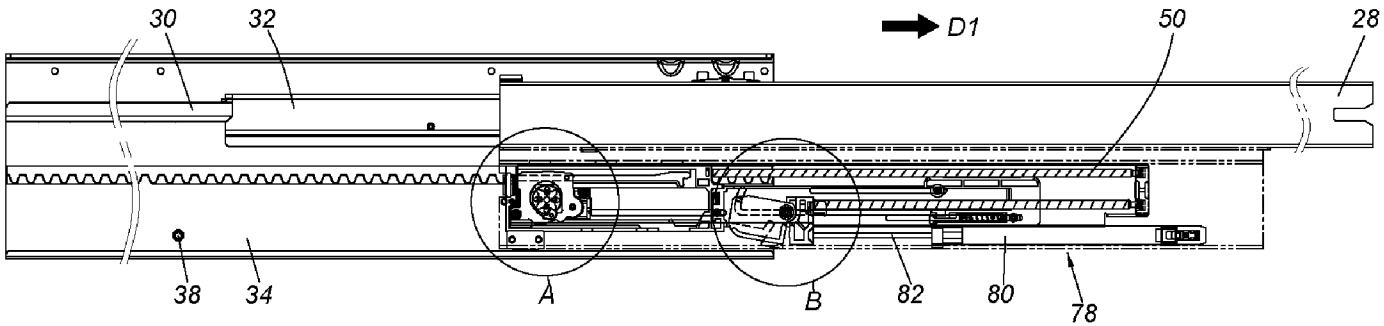
FIG. 27 is a diagram showing the clutch of the slide rail assembly being in the second state, and the first elastic member releasing an elastic force to drive the first rail to move relative to the second rail along the first direction according to an embodiment of the present invention.
Figure 29:
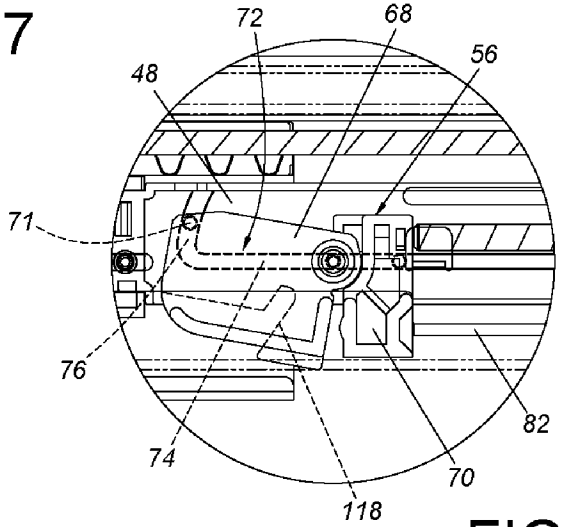
FIG. 29 is an enlarged view of an area B of FIG. 27 for illustrating the capturing member of the connecting device being deflected relative to the blocking member without capturing the portion of the second rail.
Figure 28:
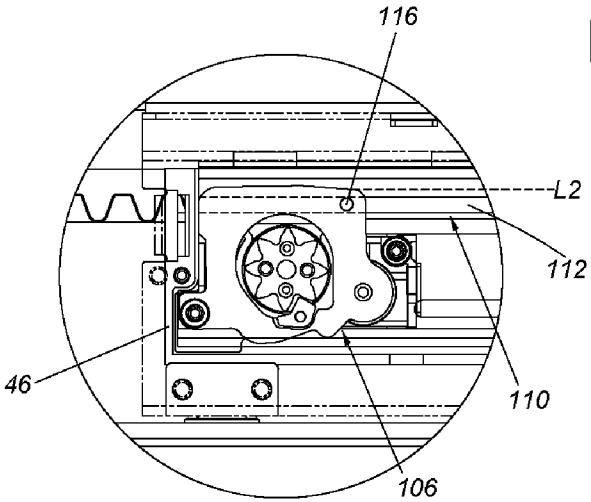
FIG. 28 is an enlarged view of an area A of FIG. 27 for illustrating the first base being located at an end part relative to the clutch.

As shown in FIG. 27, FIG. 28 and FIG. 29, when the control base 106 is in the second state L2 (that is to say, the guiding member 116 of the control base 106 is located in the first path 112 of the control path 110) and the external force along the second direction D2 no longer exists, the first elastic member 50 releases the first elastic force to drive the first rail 28 to move relative to the second rail 30 from the retracted position P1 along the first direction D1. In other words, when the control base 106 of the clutch 54 is in the second state L2, the clutch 54 unlocks the first elastic member 50, such that the first elastic member 50 releases the first elastic force to allow the first base 46 and the second base 48 to move with the first rail 28 along the first direction D1. Briefly, the first rail 28 can be opened relative to the second rail 30 in response to the first elastic force being released by the first elastic member 50. Wherein, when the second base 48 is moved along the first direction D1, the guiding path 72 of the second base 48 is moved relative to the capturing member 68 to allow the first pin 71 of the capturing member 68 to enter the transverse path 76 from the longitudinal path 74 of the guiding path 72. Accordingly, the capturing member 68 is deflected relative to the blocking member 70 in order to detach the capturing feature 118 of the capturing member 68 from the engagement feature 38 on the extension base 34. In addition, the damping rod 82 of the damping device 78 is extended outward relative to the cylinder 80 to be in a damping ready state and corresponds to the blocking member 70 of the connecting device 56.

Figure 30:
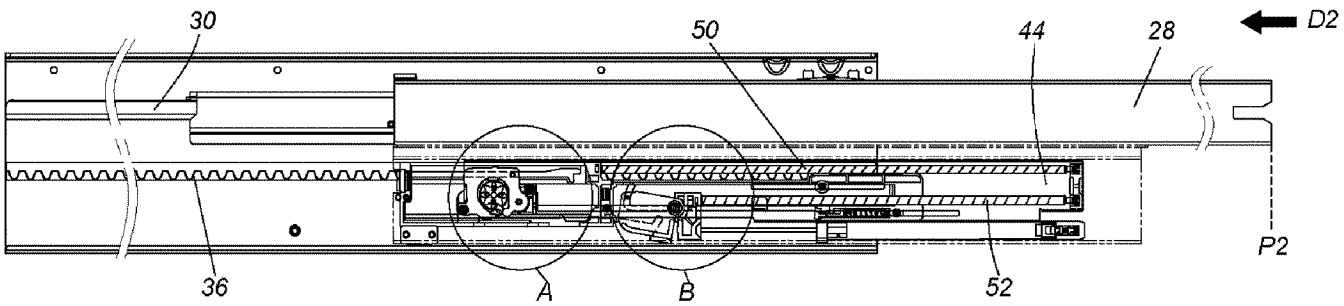
FIG. 30 is a diagram showing the first rail of the slide rail assembly being retracted relative to the second rail from an open position along the second direction according to an embodiment of the present invention.
Figure 32:
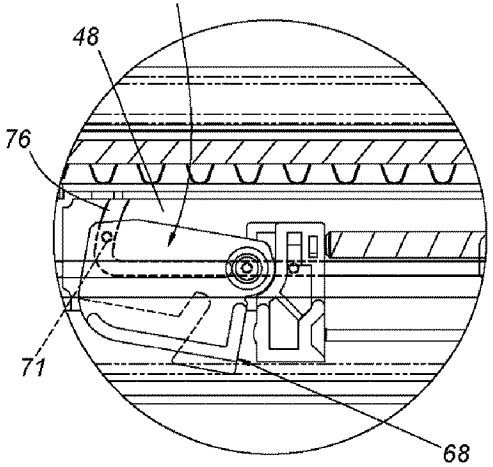
FIG. 32 is an enlarged view of an area B of FIG. 30 for illustrating the capturing member of the connecting device being deflected relative to the blocking member.
Figure 31:
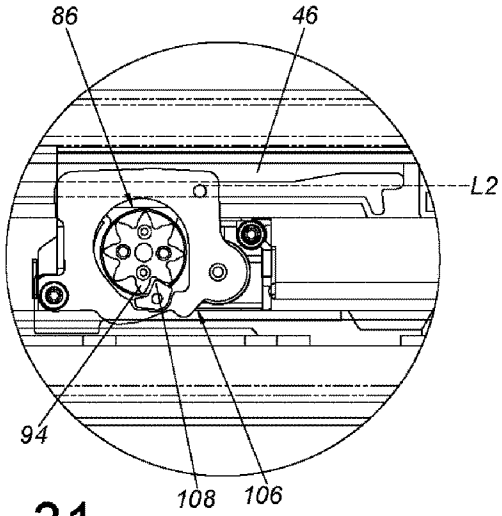
FIG. 31 is an enlarged view of an area A of FIG. 30 for illustrating the first base being moved a distance relative to the clutch and remaining in the second state.

As shown in FIG. 30, FIG. 31 and FIG. 32, when the first rail 28 is moved relative to the second rail 30 from an open position P2 along the second direction D2 by an external force (that is to say, the first furniture part 22 is moved relative to the second furniture part 24 from the open position P2 along the second direction D2 by the external force), the first base 46 and the second base 48 are moved with the first rail 28 along the second direction D2. Wherein, since the clutch 54 is in an engaging state (such as the abutting member 96 in FIG. 8 abutting against the first abutting part 98 of the first transmission member 84 and the second abutting part 100 of the of the second transmission member 86) with the engaging member 108 engaging with the engagement section 94 of the second transmission member 86, the first transmission member 84 is not movable on the auxiliary track 36 along the second direction D2. In such state, the first elastic member 50 accumulates a first elastic force in response to the external force, and the second elastic member 52 also accumulates a second elastic force in response to the external force. In particular, when the first base 46 is moved relative to the second rail 30 in response to the external force, the first elastic member 50 is stretched by the first base 46 to accumulate the first elastic force. On the other hand, since the first pin 71 of the capturing member 68 is held in the transverse path 76 of the guiding path 72, the second elastic member 52 is stretched by the second base 48 to accumulate the second elastic force.

Figure 33:
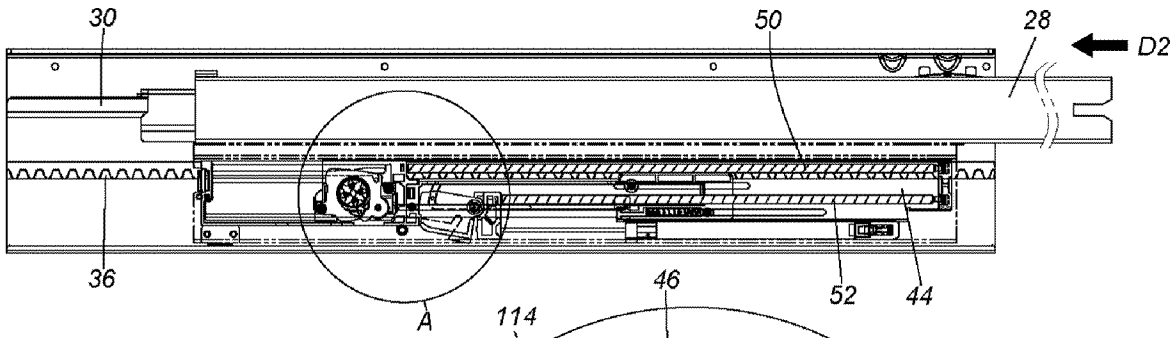
FIG. 33 is a diagram showing the first rail of the slide rail assembly being further retracted relative to the second rail from the open position along the second direction according to an embodiment of the present invention.
Figure 34:
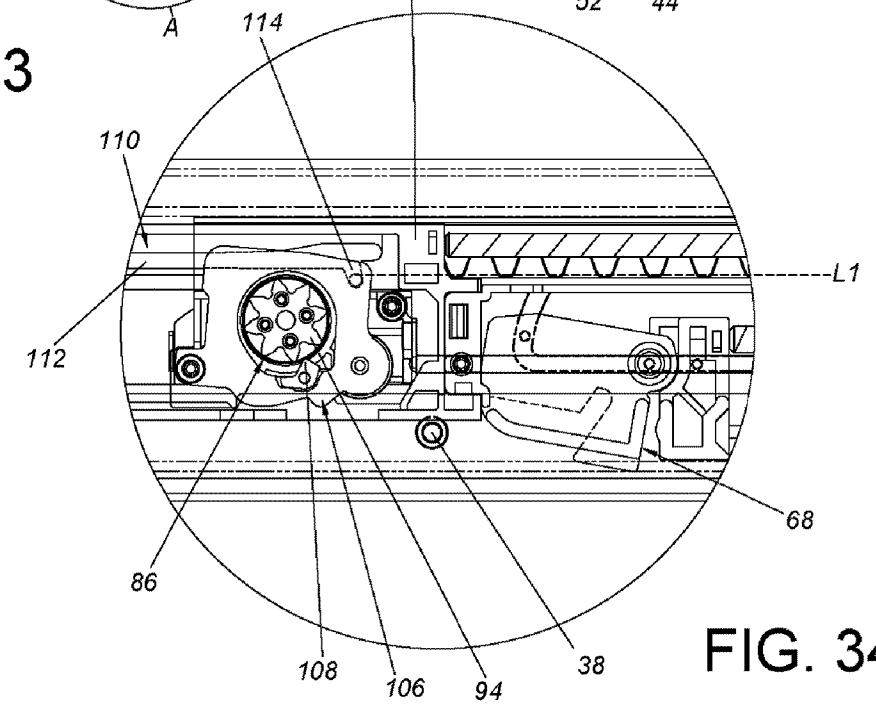
FIG. 34 is an enlarged view of an area A of FIG. 33 for illustrating the first base being moved relative to the clutch to be in the first state, and the capturing member of the connecting device being ready to capture the portion of the second rail.

As shown in FIG. 33 and FIG. 34, when the first rail 28 is moved a predetermined distance relative to the second rail 30 from the open position P2 toward the retracted position P1 along the second direction D2 (such as the first rail 28 being moved the longitudinal distance X of the first path 112 of the control path 110), the first base 46 is moved to allow the guiding member 116 of the control base 106 to return to the second path 114 from the first path 112 of the control path 110, such that the control base 106 is switched from the second state L2 back to the first state L1 relative to the second transmission member 86. Accordingly, the engaging member 108 does not engage with the engagement section 94 of the second transmission member 86. In such state, the first elastic member 50 and the second elastic member 52 can respectively accumulate the first elastic force (or the first driving force) and the second elastic force (or the second driving force). In other words, the control base 106 of the clutch 54 is recovered to the state of locking the first elastic member 50 in response to the first rail 28 being moved the predetermined distance relative to the second rail 30. Wherein, the second elastic force of the second elastic member 52 can be applied to the connecting member 44 along the second direction D2. On the other hand, the capturing member 68 is ready to capture the engagement feature 38 of the second rail 30.

Figure 35:
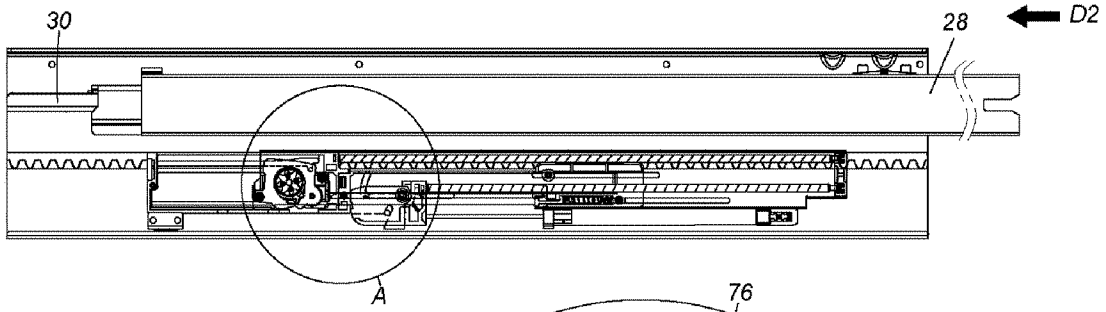
FIG. 35 is a diagram showing the first rail of the slide rail assembly being further retracted relative to the second rail from the open position along the second direction according to an embodiment of the present invention.
Figure 36:
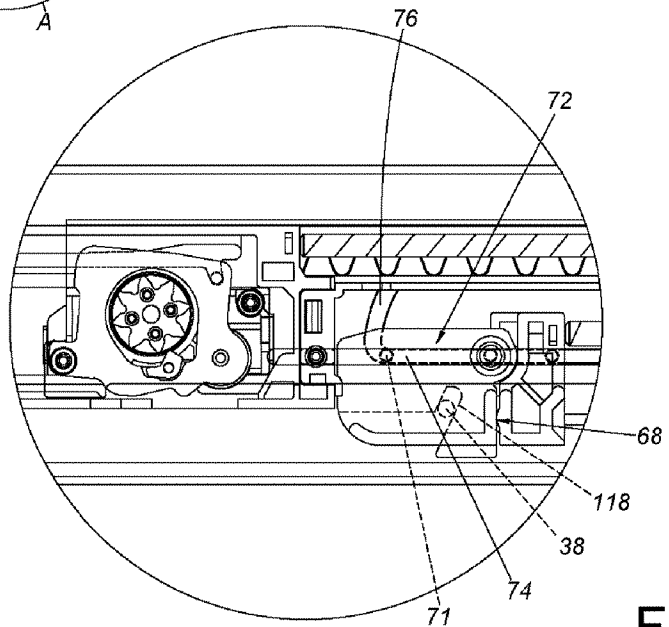
FIG. 36 is an enlarged view of an area A of FIG. 35 for illustrating the clutch being in the first state, and the capturing member of the connecting device capturing the portion of the second rail to be deflected.

As shown in FIG. 35 and FIG. 36, in an end process of the first rail 28 being retracted relative to the second rail 30 along the second direction D2, the capturing feature 118 of the capturing member 68 captures the engagement feature 38 of the second rail 30, such that the first pin 71 of the capturing member 68 is moved away from the transverse path 76 to the longitudinal path 74 of the guiding path 72. That is to say, the capturing member 68 is deflected relative to the blocking member 70 to be adjacent to the blocking member 70.

Figure 37:
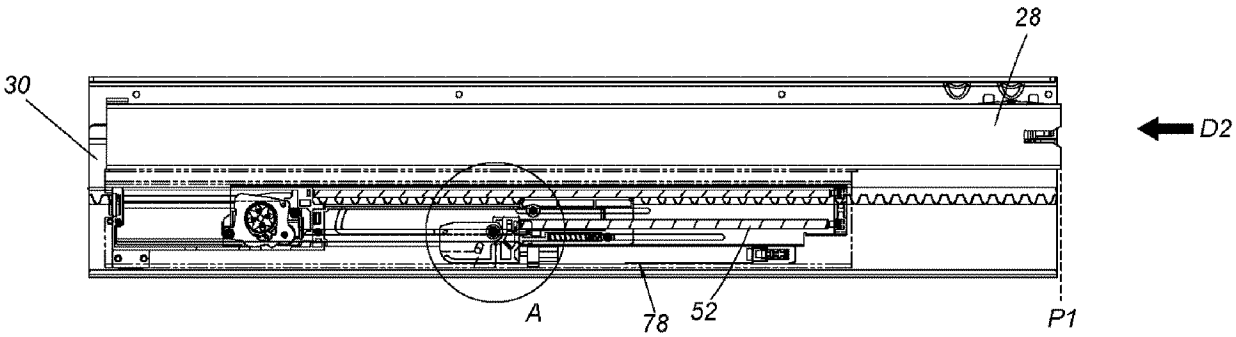
FIG. 37 is a diagram showing the first rail of the slide rail assembly being retracted relative to the second rail along the second direction in response to the second elastic force of the second elastic member according to an embodiment of the present invention.
Figure 38:
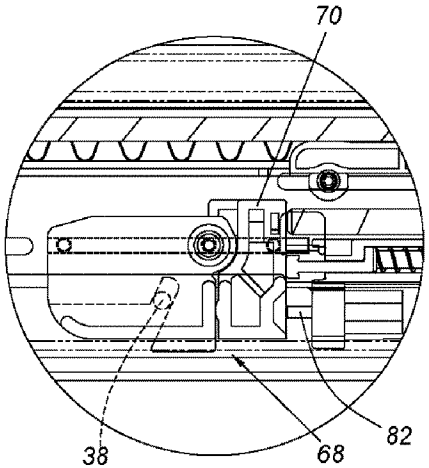
FIG. 38 is an enlarged view of an area A of FIG. 37 for illustrating a damping device providing damping effect when the first rail is retracted relative to the second rail along the second direction.

As shown in FIG. 37 and FIG. 38, when the capturing member 68 captures the engagement feature 38 of the second rail 30, the second elastic member 52 releases the second elastic force, such that the first rail 28 is retracted relative to the second rail 30 to the retracted position P1 along the second direction D2 in response to the second elastic force. In other words, the first furniture part 22 can be moved relative to the second furniture part 24 from the open position P2 to the retracted position P1 along the second direction D2 in response to the second elastic force. In addition, since the damping rod 82 of the damping device 78 abuts against the blocking member 70, the damping member 78 is configured to provide damping effect in the process of retracting the first rail 28 to the retracted position P1 relative to the second rail 30.

According to the above arrangement, the present invention is characterized in that:

The engaging member 108 is movably mounted in the limited space of the control base 106, such that when the engagement sections 94 of the second transmission member 86 is engaged with the engaging member 108, the engaging member 108 can be driven to deflect by the engagement section 94 of the second transmission member 86, in order to prevent impact or jolt between the second transmission member 86 and the engaging member 108. In other words, if the engaging member 108 is fixedly mounted to the control base 106, impact or jolt may occur during re-engagement of the engagement section 94 of the second transmission member 86 and the engaging member 108. In the embodiment of the present invention, the engaging member 108 is movably mounted in the limited space of the control base 106. When the engaging member 108 is going to be engaged with the engagement section 94 of the second transmission member 86, the engaging member 108 is driven to deflect accordingly, so as to reduce impact or jolt between the second transmission member 86 and the engaging member 108.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A clutch, comprising:

a first transmission member;

a second transmission member movably connected to the first transmission member;

at least one abutting member movably mounted between the first transmission member and the second transmission member, wherein the first transmission member has a first abutting part, the second transmission member has a second abutting part, an abutting space is defined by the first abutting part and the second abutting part and configured to accommodate the at least one abutting member; when the at least one abutting member is located at a predetermined position, the at least one abutting member abuts against the first transmission member and the second transmission member; when the at least one abutting member is moved away from the predetermined position, the at least one abutting member does not abut against the first transmission member and the second transmission member;

a control base configured to be in one of a first state and a second state relative to the second transmission member; and an engaging member movably mounted on the control base;

wherein when the control base is in the first state, the engaging member is not engaged with the second transmission member;

wherein when the control base is in the second state, the engaging member is engaged with the second transmission member.

2. The clutch of claim 1, wherein the first transmission member and the second transmission member are pivoted to each other by a shaft.

3. The clutch of claim 1, wherein the second transmission member comprises a main body part and a housing part, the main body part is configured to accommodate the housing part, the main body part comprises a plurality of engagement sections separated from each other.

4. The clutch of claim 3, wherein the engaging member is pivoted to the control base by a shaft part, and the engaging member corresponds to the plurality of engagement sections of the second transmission member.

5. The clutch of claim 1, wherein the control base has a recessed part and two separated walls located adjacent to the recessed part, the recessed part provides a limited space, in order to allow the engaging member to be limitedly movable in the limited space.

6. A driving mechanism, configured to drive a first furniture part to move relative to a second furniture part, the driving mechanism comprising:

a first elastic member;

a clutch configured to releasably lock the first elastic member, the clutch comprising a first transmission member, a second transmission member, at least one abutting member, a control base and an engaging member; wherein the first transmission member is movable on the second furniture part, the second transmission member is movably connected to the first transmission member, an abutting space is defined by the first transmission member and the second transmission member and configured to accommodate the at least one abutting member, the at least one abutting member is configured to abut against the first transmission member and the second transmission member when the at least one abutting member is located at a predetermined position, the at least one abutting member does not abut against the first transmission member and the second transmission member when the at least one abutting member is moved away from the predetermined position, the control base is configured to be selectively in one of the first state and the second state, the engaging member is pivoted to the control base;

a second elastic member; and a connecting device connected to the second elastic member;

wherein when the clutch locks the first elastic member, the first elastic member accumulates a first elastic force; and when the clutch releases the first elastic member, the first elastic member releases the first elastic force to drive the first furniture part to move relative to the second furniture part from a retracted position toward an open position along a first direction;

wherein when the first furniture part is moved a predetermined distance relative to the second furniture part from the open position toward the retracted position along a second direction, the control base is switched from the second state to the first state in order to lock the first elastic member, and the second elastic member generates a second elastic force, such that the first furniture part is configured to be moved relative to the second furniture part from the open position to the retracted position along the second direction in response to the second elastic force.

7. The driving mechanism of claim 6, wherein the control base has a recessed part providing a limited space, the engaging member is limitedly movable in the limited space of the control base.

8. The driving mechanism of claim 7, wherein when the control base is in the second state, the engaging member engages with the second transmission member; and when the control base is in the first state, the engaging member does not engage with the second transmission member.

9. The driving mechanism of claim 7, wherein the second furniture part comprises an auxiliary track arranged along a longitudinal direction of the second furniture part, and the first transmission member is movable along the auxiliary track.

10. The driving mechanism of claim 7, further comprising a first base connected to the first furniture part, wherein one of the first base and the control base has a control path, the control path comprises a first path and a second path deflected relative to the first path, the control path is configured to move the control base to be in one of the second state and the first state, and the predetermined distance is defined by the first path.

11. The driving mechanism of claim 10, further comprising a second base connected to the first furniture part, wherein the second base has a guiding path comprising a longitudinal path and a transverse path communicated with the longitudinal path, the connecting device is movably mounted to the second base through the guiding path and comprises a blocking member and a capturing member pivoted to the blocking member.

12. A clutch applicable to a first base and a connecting member, the clutch comprising:

a first transmission member;

a second transmission member movably connected to the first transmission member;

a control base having a portion pivoted to the connecting member, the control base arranged with a guiding member; and an engaging member movably mounted on the control base;

wherein the control base has a recessed part and two separated walls located adjacent to the recessed part, the recessed part provides a limited space to allow the engaging member to be limitedly movable in the limited space;

wherein the first base provide a space to accommodate the clutch, the first base has a control path, the control path comprises a first path and a second path communicated with the first path and deflected relative to the first path, the guiding member is configured to cooperate with the control path;

wherein when the guiding member is located in the second path of the control path of the first base, the control base is in the first state, and the engaging member does not engage with the second transmission member;

wherein when an external force is applied to the first base, the control base is guided by a wall in the second path of the first base to deflect, in order to allow the guiding member to enter the first path from the second path of the control path, and the engaging member engages with the second transmission member.

13. The clutch of claim 12, wherein the first transmission member and the second transmission member are pivoted to each other by a shaft.

14. The clutch of claim 13, further comprising at least one abutting member movably mounted between the first transmission member and the second transmission member; wherein the first transmission member has a first abutting part, the second transmission member has a second abutting part, an abutting space is defined between the first abutting part and the second abutting part and configured to accommodate the at least one abutting member; when the at least one abutting member is located at a predetermined position, the at least one abutting member abuts against the first transmission member and the second transmission member; and when the at least one abutting member is moved away from the predetermined position, the at least one abutting member does not abut against the first transmission member and the second transmission member.

15. The clutch of claim 14, wherein the second transmission member comprises a main body part and a housing part, the main body part is configured to accommodate the housing part, the main body part comprises a plurality of engagement sections separated from each other.

16. The clutch of claim 12, wherein the engaging member is pivoted to the control base by a shaft part.

* * * * *